US009869244B2

(12) United States Patent
Warren et al.

(10) Patent No.: US 9,869,244 B2
(45) Date of Patent: Jan. 16, 2018

(54) IGNITION SOURCE ADAPTED FOR POSITIONING WITHIN A COMBUSTION CHAMBER

(75) Inventors: James C. Warren, Fairfax, VA (US); Dennis K. Scheer, Birmingham, MI (US)

(73) Assignee: Warren Engine Company, Inc., Alexandria, VA (US)

( * ) Notice: Subject to any disclaimer, the term of this patent is extended or adjusted under 35 U.S.C. 154(b) by 1019 days.

(21) Appl. No.: 12/291,326

(22) Filed: Nov. 7, 2008

(65) Prior Publication Data

US 2009/0126669 A1 May 21, 2009

Related U.S. Application Data

(63) Continuation-in-part of application No. 11/589,118, filed on Oct. 30, 2006, now Pat. No. 7,448,352.

(60) Provisional application No. 60/731,266, filed on Oct. 31, 2005.

(51) Int. Cl.

| | |
|---|---|
| ***H01T 13/32*** | (2006.01) |
| ***F02P 15/00*** | (2006.01) |
| ***F02B 75/28*** | (2006.01) |
| ***F02P 15/04*** | (2006.01) |

(52) U.S. Cl.

CPC ..... *F02B 75/282* (2013.01); *F02P 15/00* (2013.01); *F02P 15/04* (2013.01); *H01T 13/32* (2013.01)

(58) Field of Classification Search

CPC ..... H01T 13/08; H01T 13/32; H01T 13/39; H01T 13/20; H01T 21/02; H01T 13/50; H01T 13/34; H01T 13/467; F02B 75/204; F02P 15/00; F02P 15/04

USPC ..... 123/161, 143 R, 158–162, 169 EA, 123/146.5 R, 169 PA, 169 R

See application file for complete search history.

(56) References Cited

U.S. PATENT DOCUMENTS

| | | | | |
|---|---|---|---|---|
| 3,908,146 | A * | 9/1975 | Pasbrig | 313/125 |
| 5,237,280 | A * | 8/1993 | Arnold et al. | 324/393 |
| 6,712,033 | B2 * | 3/2004 | Marforio et al. | 123/169 EA |
| 6,752,109 | B2 * | 6/2004 | Marforio et al. | 123/159 |
| 6,923,699 | B2 * | 8/2005 | Matsubara et al. | 445/7 |
| 7,004,120 | B2 * | 2/2006 | Warren | 123/43 R |
| 2007/0095320 | A1 * | 5/2007 | Warren | 123/162 |

* cited by examiner

*Primary Examiner* — Sizo Vilakazi
(74) *Attorney, Agent, or Firm* — L.C. Begin & Associates, PLLC.

(57) ABSTRACT

An ignition source for initiating combustion is provided. The ignition source includes an electrical delivery conductor mounted in a delivery conductor mounting structure. An electrical ground conductor is mounted in a ground conductor mounting structure and extends from the ground conductor mounting structure to a point proximate the delivery conductor to define an ignition spark gap between the delivery conductor and the ground conductor. At least one of the delivery conductor and the ground conductor is mounted so as to be positionable with respect to the other one of the delivery conductor and the ground conductor to selectively adjust a width of the ignition spark gap.

5 Claims, 5 Drawing Sheets

FIG - 10
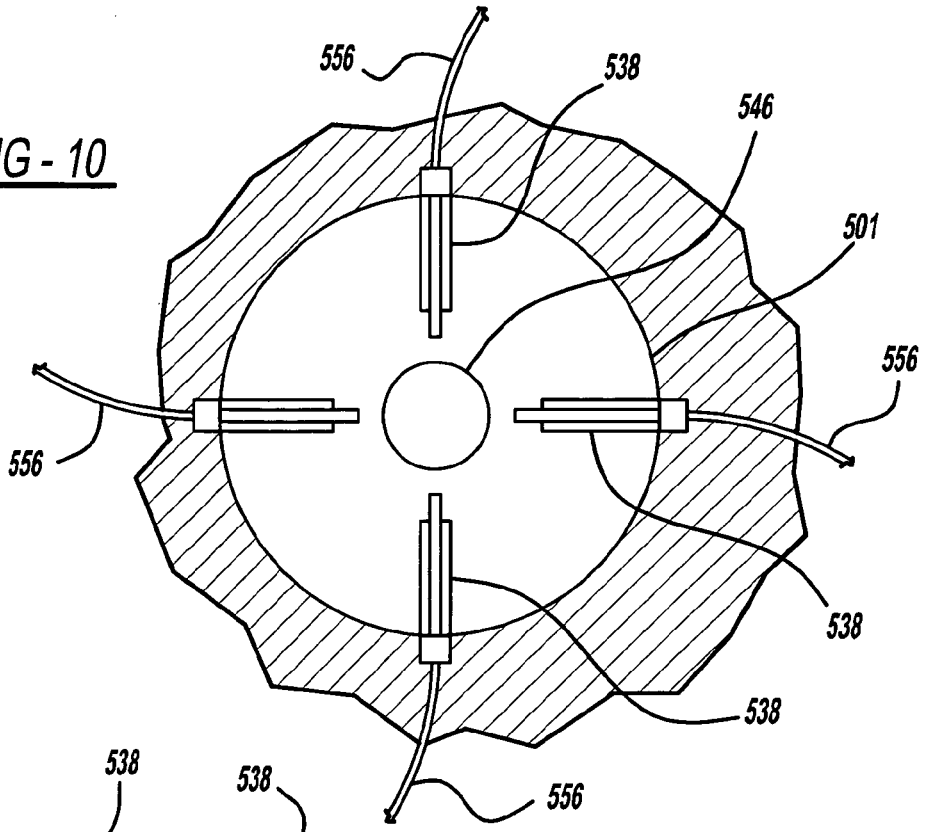
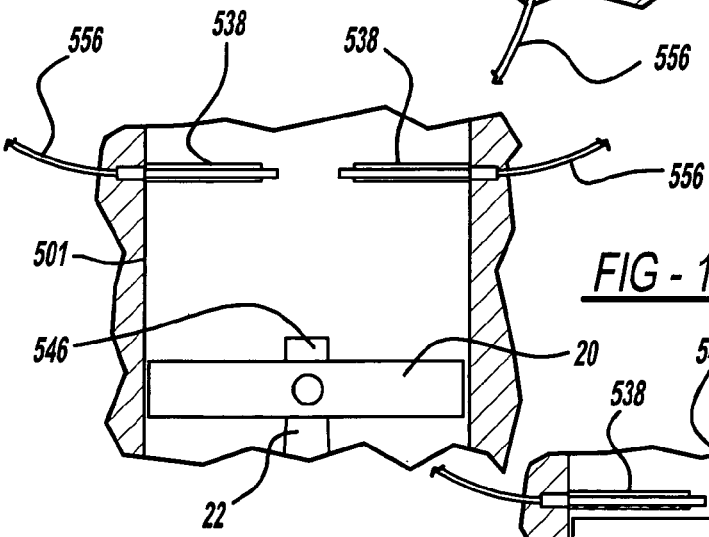
FIG - 10a
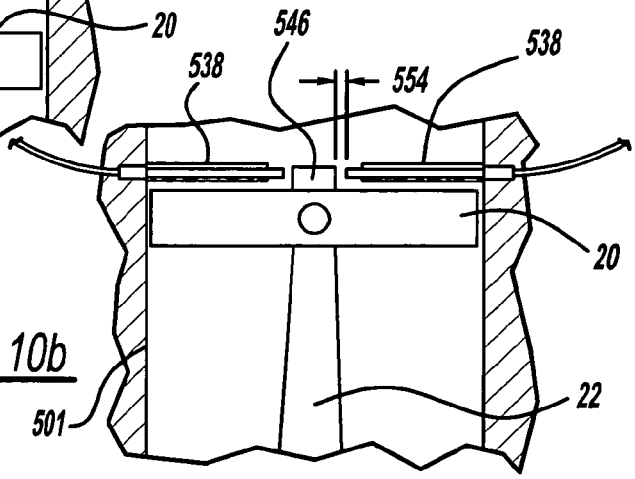
FIG - 10b

IGNITION SOURCE ADAPTED FOR POSITIONING WITHIN A COMBUSTION CHAMBER

CROSS-REFERENCE TO RELATED APPLICATIONS

This application is a continuation-in-part of U.S. application Ser. No. 11/589,118, filed on Oct. 30, 2006 now U.S. Pat. No. 7,448,352, which claims the benefit of U.S. Provisional Application No. 60/731,266 filed on Oct. 31, 2005.

BACKGROUND OF THE INVENTION

The present invention relates generally to spark ignition systems for use in combustion devices, e.g., reciprocating engines, furnaces, etc., and more particularly, to an ignition source having one or more elements adapted for adjustable positioning within the combustion device.

SUMMARY OF THE INVENTION

In one aspect of the embodiments of the present invention, an ignition source for initiating combustion is provided. The ignition source includes an electrical delivery conductor mounted in a delivery conductor mounting structure. An electrical ground conductor is mounted in a ground conductor mounting structure and extends from the ground conductor mounting structure to a point proximate the delivery conductor to define an ignition spark gap between the delivery conductor and the ground conductor. At least one of the delivery conductor and the ground conductor is mounted so as to be positionable with respect to the other one of the delivery conductor and the ground conductor to selectively adjust a width of the ignition spark gap.

BRIEF DESCRIPTION OF THE DRAWINGS

FIGS. 10-10*b* are views showing an ignition source in accordance with yet another embodiment of the present invention.

DETAILED DESCRIPTION

Figure 1:
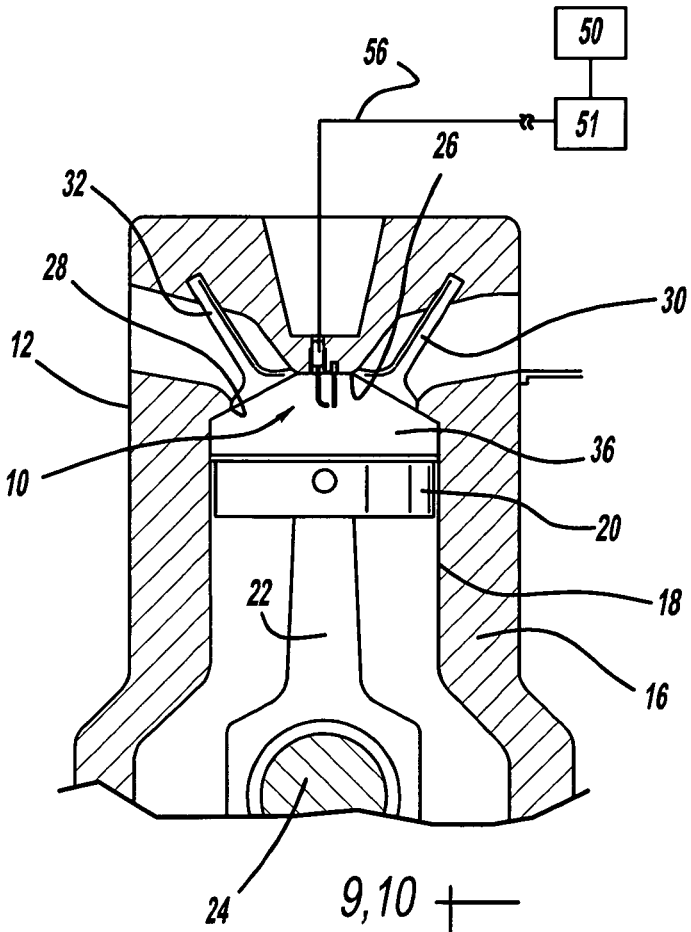
FIG. 1 is a schematic view of an internal combustion engine incorporating an ignition source in accordance with an embodiment of the present invention.

FIG. 1 shows a cross-sectional view of a portion of an internal combustion engine 12 including an ignition source, generally designated 10, positioned within a combustion chamber 18, in accordance with embodiments of the present invention. Various embodiments of a mechanism for providing an ignition spark to the interior of the combustion chamber are described herein. The combustion chamber may be any practicable volume as used in furnaces, internal combustion engines, etc.

As shown in FIG. 1, the engine 12 has a cylinder head 14, plurality of cylinder chambers 18 (one shown) defined in an engine body or cylinder block 16, and a plurality of pistons 20 (one shown) axially displaceably disposed in the cylinder chamber 18. When the piston 20 is displaced in its stroke, it changes the effective volume of the cylinder chamber 18 to cause the engine 12 to operate in intake, compression, power, and exhaust strokes, in a manner known in the art. The displacement of the piston 20 is output as drive power from the engine 12, from the piston 20 through a connecting rod 22 and a crankshaft 24.

The engine body 16 has an intake port 26 and an exhaust port 28 defined therein, which open into cylinder chamber 18. An intake valve 30 is operatively disposed in the intake port 26, and an exhaust valve 32 is operatively disposed in the exhaust port 28. The engine block, cylinder head 14, cylinders 18, and other engine components may each be formed conventionally, e.g., cast as a single, monolithic unit, or manufactured as separate components and mechanically assembled together, as desired.

Referring to FIGS. 1-5, embodiments of the ignition source described herein include conductors 38, 46 (described in greater detail below) mounted to a wall of the cylinder, to cylinder head 14, to the cylinder block or engine body 16, or to any other mounting structure suitable for mounting of the ignition source components described herein. As used herein, the term "mounting structure" is understood to mean any portion of the device into which ignition source 10 is incorporated that is suitable for mounting of either of delivery conductor 38 or ground conductor 46 therein, so as to enable the ignition source to perform the functions described herein. For example, in the embodiment shown in FIGS. 1 and 3, conductors 38, 46 are mounted in cylinder head 14 and extend into a combustion chamber defined by the cylinder head, the cylinder wall(s), and the piston 20. In the embodiment shown in FIGS. 2 and 4, conductors 38 and 46 are mounted in the cylinder block 16 and extend across at least a portion of the width of the cylinder. The delivery conductor mounting structure and the ground conductor mounting structure may comprise the same element of the device into which the ignition source is incorporated. For example, in FIG. 1, both of the delivery and ground conductors are mounted in the cylinder head. Alternatively, each of the conductors 38 and 46 could be mounted in different elements of the device (i.e., the delivery conductor could be mounted in the cylinder head, while the ground conductor is mounted in the cylinder wall). Thus, the mounting of the conductors can be adjusted to meet the requirements of a particular device geometry or functional application.

Figure 3:
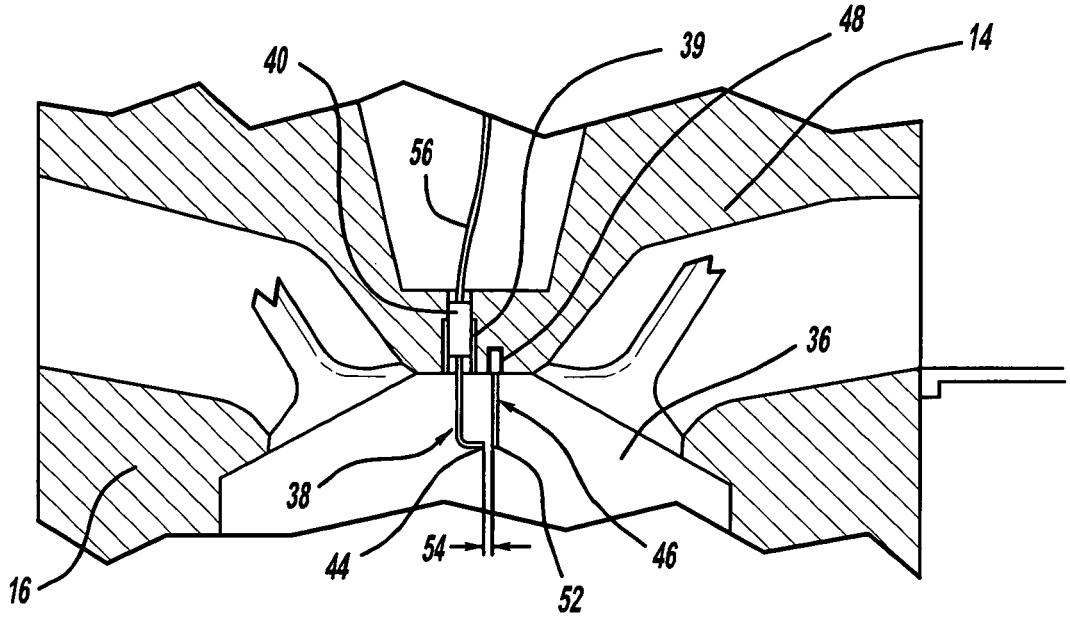
FIG. 3 is a partial cross-sectional view of an ignition source in accordance with one embodiment of the present invention extending into a combustion chamber of an engine.

FIGS. 1 and 3 illustrate ignition source 10 extending into a combustion chamber 36 formed within cylinder 18 of the engine, in accordance with one embodiment of the present invention. The ignition source includes a two-piece spark rod having an electrical delivery conductor 38 with a base end 40 that is secured to a wall of a cylinder, a portion of a cylinder head, or any other structure suitable for mounting the delivery conductor therein. While the conductor 38 is mounted to the cylinder wall or other mounting structure, the conductor may be electrically insulated from the wall and the structure in which the conductor is mounted, to prevent premature grounding. A known insulating material (for example, a polymer or ceramic material) 39 may be positioned between conductor 38 and the structure in which the conductor is mounted so as to electrically isolate the delivery conductor from the mounting structure.

The delivery conductor 38 extends from the cylinder head 14 (or other mounting structure) into the combustion chamber 36, and terminates in an electrode end 44. In a particular embodiment, the electrode end 44 is positioned at or about the theoretical geometric center of the combustion chamber 36 as defined by the cylinder wall, cylinder head, and piston at approximately the moment at which ignition of the fuel/air mixture is designed to occur. In other embodiments, conductor 38 is configured so that electrode end 44 resides at a desired position which is spaced apart from the theoretical center of the combustion chamber 36, according to the needs of a particular application. Accordingly, conductor 38 may be straight, curved (as shown in FIG. 3), or may include any combination of straight or curved portions or have any shape necessary for positioning electrode end 44 in the desired position within the combustion chamber. Conductor 38 may be any desired length and may also be either rigid or malleable (for example, bendable by a user) to enable the conductor to be shaped as needed for a particular application.

Referring again to FIG. 3, a second spark rod component comprises an electrical ground conductor 46 having an electrically grounded end 48 which is mechanically and electrically connected to a wall of the cylinder, a portion of the cylinder head 14, or to any other structure suitable for mounting the ground conductor therein. The structure in which ground conductor 46 is mounted may be the same structure or a different structure from that in which delivery conductor 38 is mounted.

End 48 may be secured to any desired portion of the mounting structure, either proximate delivery conductor 38 (as shown in FIGS. 1 and 3) or spaced apart from the delivery conductor. The ground conductor 46 further includes an electrode end 52 extending into the combustion chamber 36 adjacent the electrode end 44 of the delivery conductor 38. Accordingly, ground conductor 46 may be straight (as shown in FIGS. 1 and 3), curved, or may include any combination of straight or curved portions or have any shape necessary for positioning electrode end 52 in the desired position adjacent electrode end 44 within the combustion chamber.

Conductor 46 may be any desired length and may also be either rigid or malleable (for example, bendable by a user) to enable the conductor to be shaped as needed for a particular application.

The two electrode ends 44 and 52 of the two conductors 38 and 46 define an ignition spark gap 54 therebetween, with a spark jumping the gap 54 when sufficient electrical potential is applied to the delivery conductor 38. In an embodiment where electrode end 44 (and, therefore, spark gap 54) is positioned at or proximate the theoretical center of the combustion chamber volume, substantially optimum ignition of the fuel/air mixture within the combustion chamber is facilitated, with the combustion propagation spreading essentially uniformly in all directions from such a centrally located ignition source. In engine applications, the ability to centrally position the ignition origination point may permit the engine to operate on less costly fuels having lower antiknock ratings, thereby providing greater economy of operation. Accordingly, such an ignition source may find widespread application in numerous combustion devices and systems, and may serve to increase the operating efficiency and economy of such devices in which it is installed.

In several of the embodiments shown herein, the dimension of the spark gap 54 may be adjusted by providing a threaded base end for one or more of the two conductors, inserting the base end of the conductor into its associated mounting structure, and threadedly rotating the conductor inwardly or outwardly in its attachment to the mounting structure. For example, delivery conductor 38 may be mounted in a threaded sleeve 39 (FIG. 3) formed from a non-conductive material or otherwise insulated from the device in which the conductor is mounted. This sleeve 39 could also provide a conduit enabling electrical connection of the delivery conductor 38 to the voltage supply line (described below).

Ground conductor 46 may be mounted in a threaded hole (as shown in FIG. 3) formed in an element of the device that is electrically connected to ground. Alternatively, ground conductor 46 could be mounted in a threaded sleeve (not shown) electrically connected to an element of the device that is electrically connected to ground. Other modes of controlling the positioning of the conductors are also contemplated.

Referring again to FIGS. 1 and 3, an electrical supply line 56 extends through the cylinder wall, cylinder head, or other mounting structure into which delivery conductor 38 is mounted. Supply line 56 electrically communicates with delivery conductor 38. A controller 50 (see FIG. 1) is coupled to a voltage source 51 and/or to the supply line for regulating application of a voltage to delivery conductor 38. Supply line 56 provides electrical power to the delivery conductor 38 responsive to a command from the controller.

The controller may be set or programmed to periodically activate the voltage source, to permit periodic electrical communication between the voltage source and the delivery conductor, or otherwise to regulate application of a voltage to delivery conductor 38 so as to generate a spark at spark gap 54, in a manner timed to substantially coincide with maximum compression of the fuel/air mixture during the engine cycle (for example, when the piston is at or near top dead center). In other applications (for example, in a furnace) (not shown), application of the voltage to the delivery conductor may be regulated based on feedback received from a thermostat or other control device, in a manner known in the art.

The controller 50 may be a micro-processor based controller or any other controller suitable for regulating the timing of voltage application to the delivery conductor in accordance with the requirements of the desired combustion cycle, combustion schedule, or other combustion actuation event.

Figure 2:
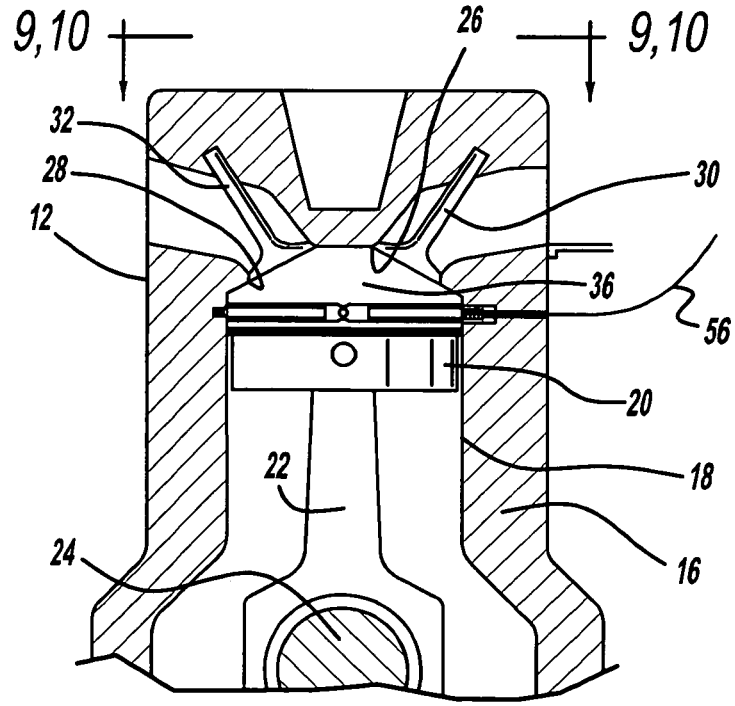
FIG. 2 is a schematic view of an internal combustion engine incorporating an ignition source in accordance with another embodiment of the present invention.
Figure 4:
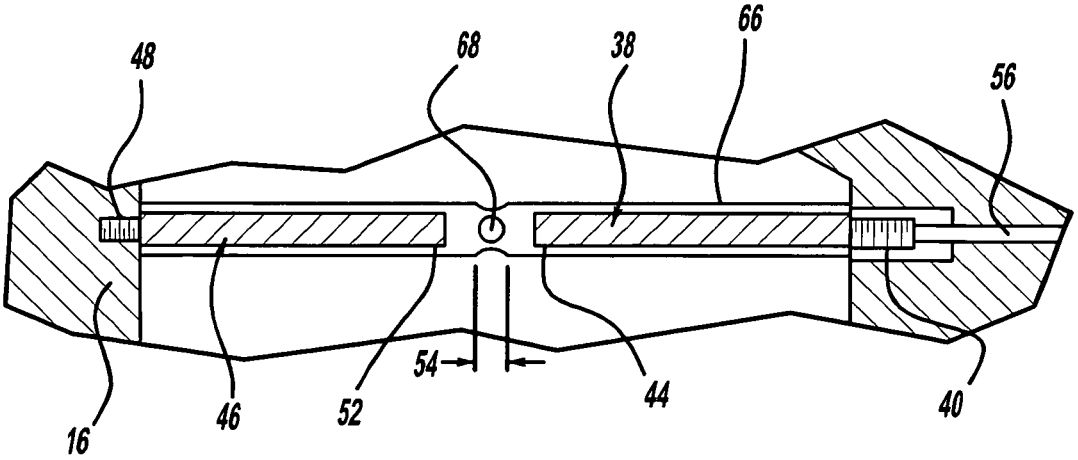
FIG. 4 is a partial cross-sectional view of an ignition source in accordance with another embodiment of the present invention extending into a combustion chamber of an engine.

While electrical insulation along the entire lengths of the delivery and/or ground conductors 38 and 46 may not be required in cases where there is a relatively large distance between the delivery conductor 38 and any electrically grounding structure, such insulation can be used to provide mechanical strengthening for the ignition rod assembly comprising the two conductors 38 and 46. Referring to FIGS. 2 and 4, in one embodiment, an electrical insulator is in the form of a continuous tube 66 surrounding the two conductors 38 and 46. Tube 66 may be formed from any suitable insulating material (for example, a suitable polymer material or a ceramic material), and may be either relatively rigid or relatively flexible, according to the requirements of a particular application.

Another potential benefit of covering portions of the electrodes with an insulating material which joins the electrodes is that the material aids in preventing or attenuating vibration and/or flexure of the electrodes due to pressure fluctuations and gas flow within the combustion chamber. Forces generated by such occurrences may adversely affect the size of the spark gap, thereby affecting ignition efficiency and timing.

In the embodiment shown in FIGS. 2 and 4, the insulator tube 66 includes at least one spark exposure aperture or passage 68 adjacent the spark gap 54, to allow the air/fuel mixture to circulate and flow therethrough in the vicinity of the spark gap 54 in order for an ignition spark to ignite the air/fuel mixture when the spark occurs, and in general to enable fluid communication between electrode ends 44 and 52 and the air/fuel mixture. In an alternative embodiment (not shown), a series of spark exposure passages 68 are formed along tube 66 in the vicinity of spark gap 54.

In one embodiment, tube 66 is relatively rigid and provides additional physical or mechanical strengthening for the ignition rod assembly. In another particular embodiment (shown in FIG. 5), an insulation tube covers only a portion of conductors 38 and 46, or only the electrode ends of the conductors. Tube 66 is formed from a relatively flexible material which permits the angular configuration of the spark rod assembly to be adjusted according to the needs of a particular application, while maintaining the desired spatial relationship between the electrode ends of conductors 38 and 46. Conductors 38 and 46 may be inserted into opposite ends of tube 66 and oriented at the desired angle θ to help ensure that a minimum desired spark gap will be achieved in the desired orientation of the conductors. The conductors may be bonded to the tube using an adhesive or methods to retain the electrode portions of the conductors within the tube. As previously described, an opening 68 is provided to enable flow of the air/fuel mixture through the tube in the vicinity of the spark gap, and to enable fluid communication between the generated spark and the fuel/air mixture within the combustion chamber.

In this embodiment, tube 66 may be formed from a flexible ceramic material or other insulating material capable of withstanding the operating conditions within the combustion chamber and performing the desired functions. Flexible ceramic materials and other ceramic materials suitable for the applications described herein may be obtained from vendors such as Cotronics Corp. of Brooklyn, N.Y. or Morgan Technical Ceramics of Fairfield, N.J.

Figure 6:
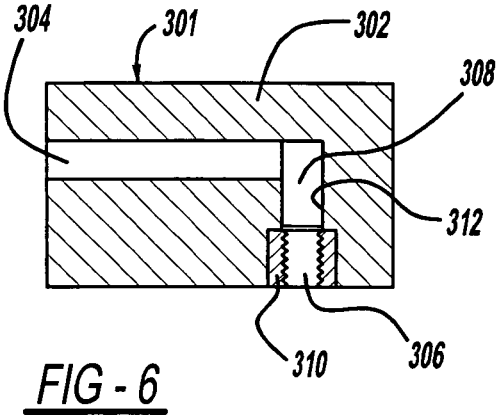
FIG. 6 is a cross-sectional side view of a connector for enabling control of a dimension of a spark gap, in accordance with an embodiment of the present invention.
Figure 7:
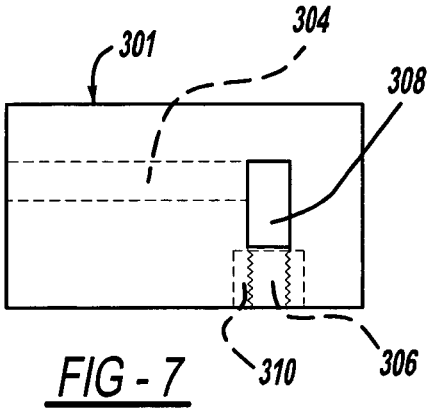
FIG. 7 is a side view of the connector shown in FIG. 6.
Figure 8:
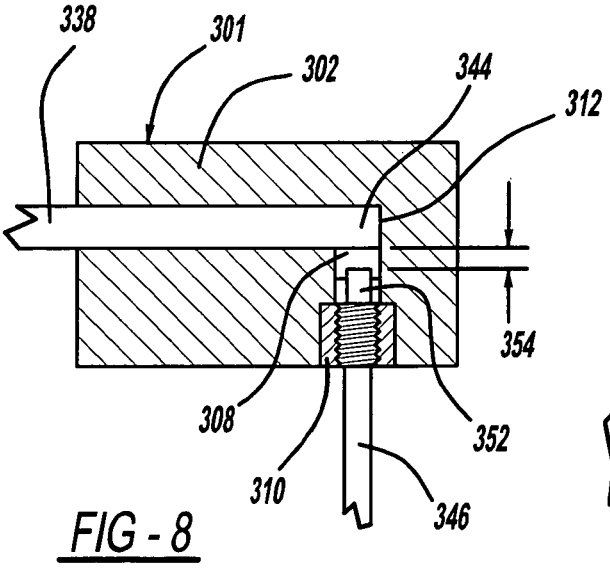
FIG. 8 is the connector cross-sectional side view of FIG. 6 showing a delivery conductor and a ground conductor mounted in the connector.
Figure 5:
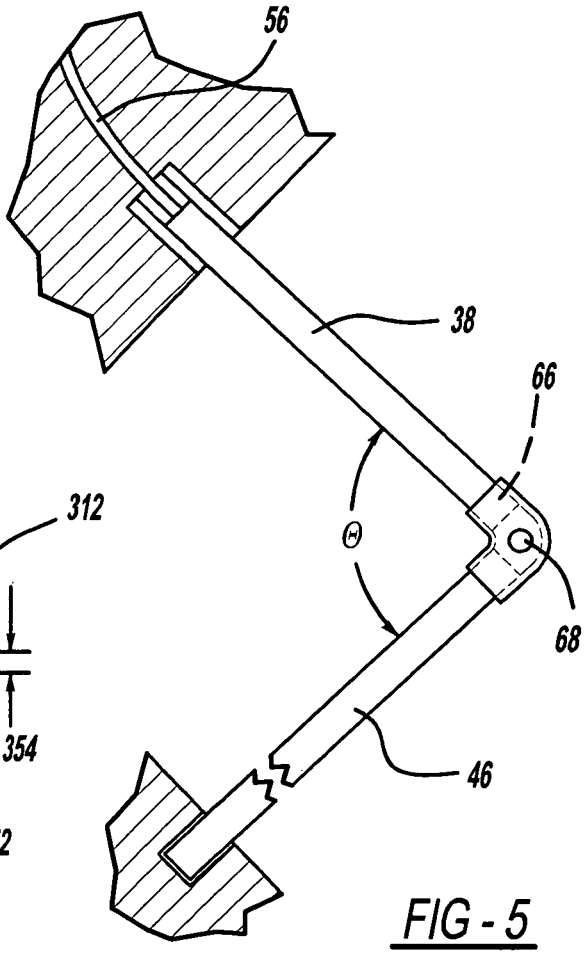
FIG. 5 is a partial cross-sectional view of an ignition source in accordance with yet another embodiment of the present invention extending into a combustion chamber of an engine.

Referring to FIGS. 6-8, in yet another embodiment, a connector 301 is provided to enable control of the spark gap dimension 354. Connector 301 includes a body 302, a first shaft 304 for receiving a portion of one of delivery conductor 338 or ground conductor 346 therein, and a second shaft 306 for receiving therein the other one of delivery conductor 338 or ground conductor 346. In the embodiment shown in FIGS. 6-8, delivery conductor 338 is positioned in shaft 304 and ground conductor 346 is positioned in shaft 306. However, depending on the requirements of a particular application, either of conductors 338 and 346 may be positioned in either of shafts 304 and 306. Connector 301 also has a through hole 308 extending completely through the body of the connector, and a threaded insert 310 extending into at least one of shafts 304 or 306. Alternatively, threads for engaging one of conductors 338 or 346 (as described below) may be formed into connector body 302.

FIG. 8 shows one example of how conductors 338 and 346 may be positioned and secured within the connector so as to enable control of the spark gap. In FIG. 8, delivery conductor is inserted into shaft 304 until the electrode end 344 of the conductor abuts a stop surface 312 formed within the connector interior. The delivery connector is then secured in this position using any of a variety of known methods, for example, adhesive application, heat staking, etc. Ground conductor 346 is then threadedly inserted into shaft 306. It will be noted that, in this application, ground conductor 346 has a threaded end portion proximate electrode end 352, which is designed to engage complementary threads on threaded insert 310. The ground conductor is threadedly inserted into shaft 306 to a depth such that a desired spark gap dimension is achieved between the electrode ends of the ground conductor and the delivery conductor. An opposite end of the ground conductor may then be inserted into and secured to the ground conductor mounting structure as previously described.

If desired, once a given spark gap dimension has been achieved, the threaded end of the ground conductor may be permanently affixed to the connector so as to prevent any further rotation of the ground conductor with respect to the connector, thereby permanently fixing the spark gap dimension. Through hole 308 enables flow of the air/fuel mixture through the tube in the vicinity of the spark gap 354, and enables fluid communication between the generated spark and the fuel/air mixture within the combustion chamber. Connector 301 may be formed form a ceramic or other suitable insulating material.

Figure 9:
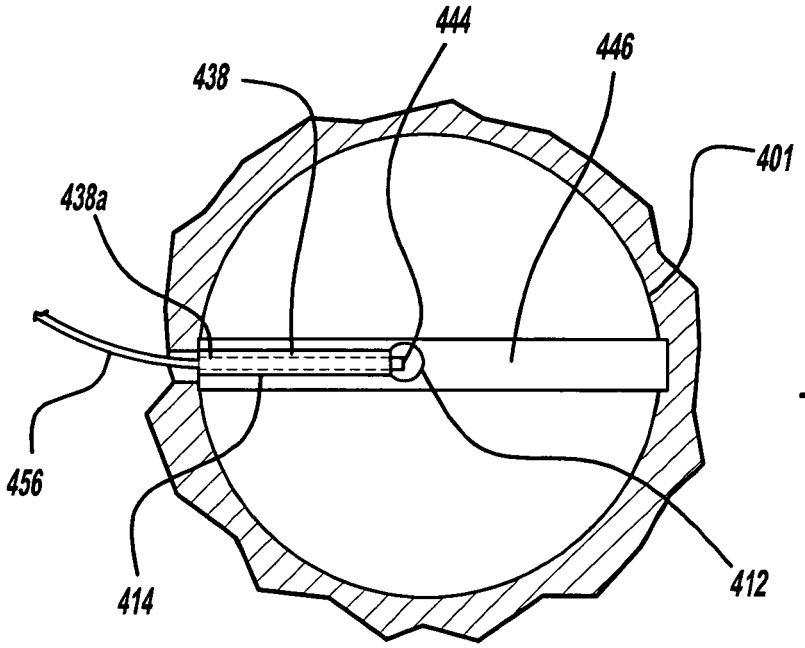
FIGS. 9-9*a* are views showing an ignition source in accordance with another embodiment of the present invention.
Figure 9A:
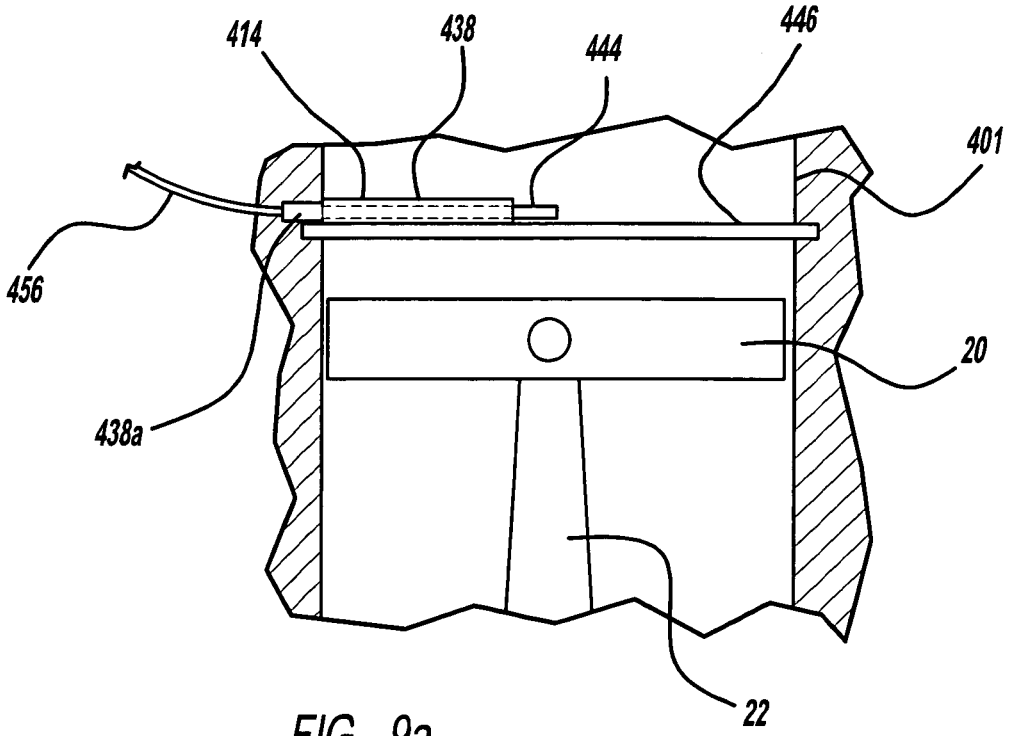

FIG. 9 shows cross-section of an engine cylinder 401 viewed in the direction indicated by arrows 9 of FIG. 2. Referring to FIGS. **9-9*a*, in another embodiment of the ignition source, a grounding strip 446 is electrically coupled to a grounding mounting structure (for example, a wall of the cylinder) as previously described. A hole 412 extends through strip 446. A delivery conductor 438 extends proximate grounding strip 446 and substantially parallel to the grounding strip. Delivery conductor 438 has a base end 438*a* mounted to a delivery conductor mounting structure and electrically coupled to a supply line 456 as previously described. Delivery conductor 438 also has an electrode end 444 positioned proximate grounding strip hole 412**.

An insulating material 414 covers the portion of the delivery conductor extending between the mounting structure and electrode end 444. In the embodiment shown in FIGS. **9-9*a*, hole 412 is substantially circular, and delivery conductor electrode end 444 extends to approximately the center of hole 412. The dimension of a spark gap between electrode end 444 and grounding strip 446 is affected by such factors as the shape and dimensions of hole 412, the length of the uninsulated portion of the delivery conductor, and the spacing between delivery conductor 438 and grounding strip 446**.

In a particular embodiment, insulating material 414 of delivery conductor 438 is bonded or otherwise attached to grounding strip 446. In the embodiment shown in FIGS. **9-9*a*, hole 412 is positioned at the approximate center of grounding strip 446. However, hole 412 may be positioned at any desired point along the length of the grounding strip, and the length of delivery conductor 438 may be adjusted accordingly. Spark gap 454 is effectively the shortest distance between the uninsulated portion of electrode end 444 and any portion of grounding strip 446. Application of a voltage to generate a spark in spark gap 454** may be controlled by a controller as previously described or by other methods.

FIG. 10 shows cross-section of an engine cylinder viewed in the direction indicated by arrows 10 of FIG. 9. FIGS. 10-10*b* shows a cross-sectional side view of the cylinder shown in FIG. 10.

Referring to FIGS. 10-10*b*, the grounding conductor 546 is in the form of a projection extending from a piston 20 which cycles within cylinder 501 as previously described. One or more delivery conductors 538 extend from one or more associated delivery conductor mounting structures and are connected to associated supply lines 556, as previously described. Portions of the lengths of conductor(s) 538 may be insulated if desired. Although multiple delivery conductors 538 are shown in FIGS. 10-10*b*, the embodiment shown may be operated using a single delivery conductor or multiple delivery conductors. If desired, portions of delivery conductors 538 may be covered with an insulating material as previously described.

FIGS. 10*a*-10*b* show the operation of this embodiment. FIG. 10*a* shows piston 20 at or near bottom dead center, while FIG. 10*b* shows piston 20 at or near top dead center. When piston projection 546 reaches a predetermined position (for example, at or near top dead center) proximate the delivery conductor 538, a spark is generated between the delivery conductor electrode end 544 and piston projection 546. Application of a voltage to delivery conductor(s) 538 to generate a spark in spark gap 554 may be controlled by a controller as previously described or by other methods. Alternatively, the delivery conductor(s) may be kept constantly energized so that a spark will pass between a delivery conductor and the piston projection whenever the projection comes within a predetermined distance from the delivery conductor electrode end, according to the cycling of the piston.

The range of electrode configurations described herein provides the ability to position the spark gap at essentially any desired point within the combustion chamber. This flexibility in positioning of the spark gap enables optimization of the combustion reaction to be facilitated within a wide variety of combustion chamber shapes and sizes, by facilitating positioning of the spark gap at or near the theoretical center of the combustion chamber for any given chamber configuration. In addition, the electrodes may be configured as needed so as lie within the combustion chamber, yet outside the path of motion of a piston mounted in the chamber. Thus, the benefits of positioning the spark source within the combustion chamber are retained.

It should be noted that although the embodiments disclosed herein are described as they may be applied to an internal combustion engine, embodiments of the present invention may be applied to other devices than engines, such as furnace combustors and the like.

It will be understood that the foregoing description of the present invention is for illustrative purposes only, and that the various structural and operational features herein disclosed are susceptible to a number of modifications, none of which departs from the spirit and scope of the present invention. The preceding description, therefore, is not meant to limit the scope of the invention. Rather, the scope of the invention is to be determined only by the appended claims and their equivalents.

What is claimed is:

1. An ignition source for initiating combustion comprising:

an electrically conductive ground strip having a length and a linear extension along all of its length; and an electrical delivery conductor at least partially enclosed within an electrically insulating tube attached to an exterior surface of the ground strip, a portion of the delivery conductor and a portion of the ground strip being positioned proximate each other to define an ignition spark gap between the delivery conductor and the ground strip, wherein said electrically insulating tube does not enclose any portion of said electrically conductive ground strip.

2. The ignition source of claim 1 wherein a through hole is formed in the conductive strip, wherein the portion of the delivery conductor resides proximate the through hole, and wherein the spark gap is defined by the portion of the delivery conductor and an edge of the through hole.

3. The ignition source of claim 1 wherein the delivery conductor is spaced apart from the ground strip by a portion of the tube.

4. An ignition source for initiating combustion within a combustion chamber bounded by opposed wall portions, the ignition source comprising:

an electrically conductive ground strip extending from a first wall portion of the opposed wall portions to a second wall portion of the opposed wall portions of the combustion chamber; and an electrical delivery conductor extending from a wall of the chamber and along the ground strip into the interior of the chamber, a portion of the delivery conductor and a portion of the ground strip being positioned proximate each other to define an ignition spark gap between the delivery conductor and the ground strip.

5. The ignition source of claim 4 wherein at least a portion the ground conductor and wherein the spark gap is positioned proximate a midpoint of the at least a portion of the ground conductor.

* * * * *